US012617580B2

(12) United States Patent
Yu

(10) Patent No.: US 12,617,580 B2
(45) Date of Patent: May 5, 2026

(54) DIGITALIZABLE AND RETURNABLE PACKAGING STRUCTURE FOR VARIOUS MODULAR ITEMS

(71) Applicant: Duyuan Yu, Monticello, NY (US)

(72) Inventor: Duyuan Yu, Monticello, NY (US)

( * ) Notice: Subject to any disclaimer, the term of this patent is extended or adjusted under 35 U.S.C. 154(b) by 84 days.

(21) Appl. No.: 18/785,347

(22) Filed: Jul. 26, 2024

(65) Prior Publication Data

US 2025/0242967 A1 Jul. 31, 2025

Related U.S. Application Data

(60) Provisional application No. 63/624,937, filed on Jan. 25, 2024.

(51) Int. Cl.
*B65D 19/00* (2006.01)
*B65D 71/00* (2006.01)

(52) U.S. Cl.
CPC ..... *B65D 19/004* (2013.01); *B65D 71/0096* (2013.01); *B65D 2519/00034* (2013.01);
(Continued)

(58) Field of Classification Search
CPC ..... B65D 19/00; B65D 19/004; B65D 19/38; B65D 71/00; B65D 71/0096;
(Continued)

(56) References Cited

U.S. PATENT DOCUMENTS 3,828,965 A 8/1974 Yarbrough
5,052,307 A 10/1991 Morrison
(Continued)

FOREIGN PATENT DOCUMENTS

CN 104680346 A 6/2015
CN 204957317 U 1/2016
(Continued)

OTHER PUBLICATIONS

Industry News, Jun. 27, 2024, Shanghai Huayuan Electronic Co. Ltd., https://www.huayuansh.com/why-use-rfid-pallet-tags-for-supply-chain-automation/.
(Continued)

*Primary Examiner* — Bryon P Gehman

(57) ABSTRACT

This invention presents a digitalizable, returnable packaging structure for a range of modular items, such as photovoltaic modules, combining environmental sustainability with advanced technology. Central to this design is a pallet featuring equidistantly spaced and concavely shaped support legs with reinforcement grooves for stability. These legs also have electronic labels (RFID, barcode, QR code) for efficient tracking. Stacked on top of the pallet is a packaging box, or multiple boxes, secured by a cover plate with placement slots and banding notches, along with binding straps for added stability. The pallet body includes side strips for module placement and features like side slots and circular grooves to optimize weight and integrity. This design ensures secure packaging and efficient transport, reducing recognition errors. Using plastic materials provides cost savings and environmental benefits, significantly enhancing photovoltaic module packaging.

12 Claims, 4 Drawing Sheets

(52) U.S. Cl.
CPC ..... *B65D 2519/00069* (2013.01); *B65D 2519/00268* (2013.01); *B65D 2519/00288* (2013.01); *B65D 2519/00318* (2013.01); *B65D 2519/00338* (2013.01); *B65D 2519/00412* (2013.01); *B65D 2519/00825* (2013.01)

(58) Field of Classification Search
CPC ..... B65D 2519/00034; B65D 2519/00069; B65D 2519/00268; B65D 2519/0288; B65D 2519/00318; B65D 2519/00338; B65D 2519/00412; B65D 2519/00825
USPC ..... 206/386, 595–600
See application file for complete search history.

(56) References Cited

U.S. PATENT DOCUMENTS

| | | | | |
|---|---|---|---|---|
| 5,566,624 | A | 10/1996 | Brown et al. | |
| 5,755,162 | A | 5/1998 | Knight et al. | |
| 7,819,068 | B2 | 10/2010 | Apps et al. | |
| 7,948,384 | B1 | 5/2011 | Kennedy | |
| 8,146,771 | B1 * | 4/2012 | Segeleon | B65D 19/18 206/386 |
| 8,511,239 | B2 | 8/2013 | Lin | |
| 8,697,801 | B2 * | 4/2014 | Zwick | C08L 23/06 524/849 |
| 11,420,790 | B2 * | 8/2022 | Neeld | B65D 19/385 |
| 11,427,385 | B1 | 8/2022 | Cutter | |
| 11,851,239 | B2 | 12/2023 | Lopez Uran et al. | |
| 11,866,250 | B2 * | 1/2024 | Argentti | B65D 19/12 |
| 2004/0025757 | A1 * | 2/2004 | Fan | B65D 71/0096 108/55.1 |
| 2005/0199623 | A1 | 9/2005 | Elder et al. | |
| 2008/0143514 | A1 | 6/2008 | Valentinsson | |
| 2009/0050030 | A1 | 2/2009 | Apps et al. | |
| 2011/0005433 | A1 | 1/2011 | Pichereau | |
| 2011/0061572 | A1 | 3/2011 | Liu et al. | |
| 2011/0132801 | A1 | 6/2011 | Elder | |
| 2011/0265695 | A1 | 11/2011 | Moore et al. | |
| 2013/0174762 | A1 | 7/2013 | Hedley et al. | |
| 2013/0274387 | A1 | 10/2013 | Zwick | |
| 2014/0000218 | A1 * | 1/2014 | Kelly | B65D 19/0004 108/51.11 |
| 2014/0231429 | A1 | 8/2014 | Frankenberg | |
| 2015/0135999 | A1 | 5/2015 | Takyar et al. | |
| 2015/0284169 | A1 | 10/2015 | Nehring | |
| 2017/0081075 | A1 | 3/2017 | Bruce et al. | |
| 2017/0137212 | A1 | 5/2017 | Erm | |
| 2017/0327271 | A1 | 11/2017 | Spadavecchia | |
| 2019/0168912 | A1 | 6/2019 | de Bokx et al. | |
| 2020/0062449 | A1 | 2/2020 | Marovac et al. | |
| 2020/0109004 | A1 | 4/2020 | Martin, Jr. et al. | |
| 2020/0317398 | A1 | 10/2020 | Gordon | |
| 2021/0053722 | A1 | 2/2021 | Berman et al. | |
| 2021/0276761 | A1 | 9/2021 | Banik | |
| 2021/0362905 | A1 | 11/2021 | Bangalore et al. | |
| 2022/0097907 | A1 | 3/2022 | Neeld | |
| 2022/0120491 | A1 | 4/2022 | Lee et al. | |
| 2022/0144540 | A1 | 5/2022 | Argentti | |
| 2022/0258915 | A1 | 8/2022 | Srichai | |
| 2022/0287284 | A1 | 9/2022 | Martínez Escribano et al. | |
| 2023/0196054 | A1 | 6/2023 | Dwyer et al. | |
| 2023/0202711 | A1 | 6/2023 | Feider et al. | |
| 2023/0312171 | A1 | 10/2023 | Vinke | |
| 2023/0356885 | A1 | 11/2023 | Baker et al. | |
| 2024/0017880 | A1 | 1/2024 | Asensio Cotillas et al. | |

FOREIGN PATENT DOCUMENTS

| | | | |
|---|---|---|---|
| CN | 110316452 | A | 10/2019 |
| CN | 211568714 | U | 9/2020 |
| CN | 213594760 | U | 7/2021 |
| CN | 214777344 | U | 11/2021 |
| CN | 113911505 | A | 1/2022 |
| CN | 215437403 | U | 1/2022 |
| CN | 115959359 | A | 4/2023 |
| CN | 117228123 | A | 12/2023 |
| DE | 29608831 | U1 | 8/1996 |
| DE | 102005004839 | A1 | 8/2006 |
| DE | 102005059950 | A1 | 6/2007 |
| DE | 102008006924 | A1 | 7/2009 |
| DE | 102009038963 | A1 | 2/2011 |
| EP | 1731434 | A1 | 12/2006 |
| WO | WO-2011092652 | A2 | 8/2011 |

OTHER PUBLICATIONS

"Module Packaging," 2022, Enlog LLC., https://www.enlog.us/packaging.
"Pallet Level Tagging: Using RFID to Track Pallet Loads," Supply Chain Traceability, May 30, 2024, iGPS,https://igps.net/pallet-level-tagging-using-rfid-to-track-pallet-loads/.
"Lip service: Does size really matter?" Latest News, Jan. 6, 2017, goplasticpallets.com, https://www.goplasticpallets.com/news/pallet-lips-size-matters.
"Adjustable, collapsible, reusable pallets engineered for solar panels." 2024, Pvpallet, Inc., https://www.pvpallet.com/solar-panel-pallet.
Mar. 8, 2019, Polymer Solutions International, Inc., https://prostack.com/2019/03/08/choosing-rfid-pallets/.
"Supply Chain Intelligence with Built-in RFID," 2023, iGPS, https://igps.net/resources/rfid-tracking/.
2024, SimplyRFID, https://www.simplyrfid.com/faq/how-do-i-tag-pallets-with-rfid/.
SmartX HUB, https://smartxhub.com/how-we-can-improve-rti-returnable-transportation-items-reusable-assets-flow/.
Claire Swedberg, "Asset-Tracking Technology Helps iGPS Rescue Its Pallets," RFID Journal, Mar. 5, 2012.

* cited by examiner

DIGITALIZABLE AND RETURNABLE PACKAGING STRUCTURE FOR VARIOUS MODULAR ITEMS

CROSS-REFERENCE TO RELATED APPLICATION

This application claims the benefit of U.S. Provisional Patent Application Ser. No. 63/624,937, filed Jan. 25, 2024.

FIELD OF THE INVENTION

The present invention pertains to the realm of packaging structures, particularly focusing on an innovative packaging solution versatile enough for various modular items, including photovoltaic modules. This novel packaging structure is distinguished by its capabilities for digital tracking and sustainable reuse.

PRIOR ART

As photovoltaic power generation technology matures, research on photovoltaic modules has become a significant subject. From the research and development of photovoltaic modules to their manufacture, and finally to delivery to customers, these modules undergo multiple transshipments and long-distance transportation. Due to the fragile and scratch-prone nature of photovoltaic modules, there is a need for an appropriate pallet packaging structure to achieve stable packaging and transportation coordination.

A pallet acts as a medium that transforms static goods into dynamic goods. It is a type of loading platform and an active platform, or rather, a movable ground. Goods that lose flexibility when placed on the ground regain mobility once loaded onto a pallet, becoming flexible flowing goods. This is because goods on a pallet are always in a state of readiness to be moved at any time.

In the context of existing pallet packaging for photovoltaic modules, several drawbacks are apparent. The prevalent use of wooden pallets, designed primarily for single-use applications, lacks sustainability and environmental friendliness. These pallets, with their paper covers and side walls, offer limited stability and precise placement for modules during transport, posing a risk to the fragile and scratch-prone nature of photovoltaic modules. Additionally, the weight management of these pallets, particularly when stacked, is often inadequate, leading to issues during transit. Furthermore, traditional pallets rely on conventional labeling methods, which are susceptible to errors in the rapid transshipment process. This can result in recognition errors and mismatches between modules and their corresponding pallets. The poor stack stability of these pallets further complicates their handling and transportation. These limitations underscore the need for an innovative approach in pallet packaging to ensure safe, efficient, and sustainable transport of photovoltaic modules.

SUMMARY OF THE INVENTION

This invention introduces an innovative digitalizable and returnable packaging structure suitable for a variety of modular items. It features advanced technology for digital tracking and environmental sustainability through reusability.

The invention includes a versatile pallet forming the base of the packaging structure. This pallet is designed with a body having sides and upper and lower ends, equipped with uniquely shaped support legs for stability and strength. The legs feature internal reinforcement and designated positions for advanced electronic labels incorporating RFID, barcode, and QR code technologies.

Above the pallet, the structure accommodates one or more packaging boxes, with a single box being preferred. These boxes are secured with a cover plate and binding straps for enhanced security.

The cover plate is designed with placement slots and banding notches for additional stability.

Further, the packaging structure incorporates design elements such as side strips and side slots on the pallet body and grooves at its ends, facilitating stable and secure transportation of a variety of items.

Advantages

Consequently, numerous benefits of one or more aspects are evident in the innovative packaging structure, which is adaptable for a range of modular items, such as photovoltaic modules. This design marks a substantial improvement over conventional pallet packaging structure. This structure, featuring a durable, reusable plastic pallet body with equidistantly mounted side strips and support legs, offers improved stability and precise placement of modules during transport, contributing to environmental sustainability.

The design includes internal reinforcement grooves within the support legs, enhancing strength and stability, and addressing the fragility of various modular items like photovoltaic modules without adding excessive weight.

Traditional pallets often struggle with weight management when stacked. This challenge is countered with side slots and substantially circular grooves in the pallet body, balancing weight reduction and structural integrity, thus enhancing transport efficiency and stability.

A significant improvement is the integration of advanced electronic labels on the support legs, utilizing RFID, barcode, and QR code components. This modern labeling system reduces recognition errors and optimizes pallet and module management.

Additionally, the integration of placement slots at the upper end of the cover plate, aligning with the support legs, provides added stability for stacked units. Features such as banding notches at the upper end of the cover plate and strap slots at the lower end of the pallet body ensure secure packaging, offering an improvement over existing methods where stack stability is often compromised.

In summary, transitioning from single-use materials to durable plastic for both the pallet and cover plate bodies, and incorporating strategic features such as placement slots, side strips, side slots, grooves, banding notches, strap slots, and electronic labels, positions this design as a comprehensive solution that enhances efficiency, stability, and environmental friendliness. Additional advantages of one or more aspects will be apparent from consideration of the drawings and ensuing description.

BRIEF DESCRIPTION OF DRAWINGS

Similar reference characters denote corresponding features consistently throughout the attached drawings.

DETAILED DESCRIPTION OF THE PREFERRED EMBODIMENTS

Figure 1:
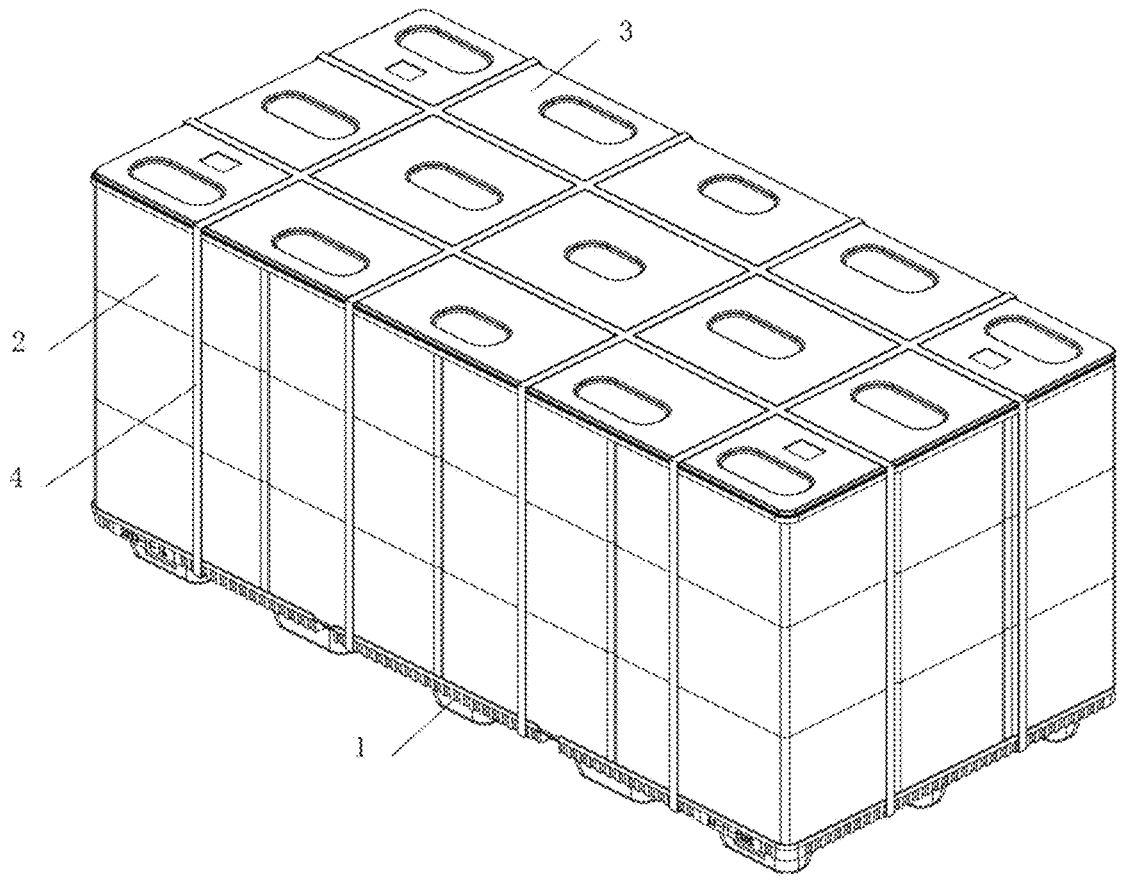
FIG. 1 is a schematic diagram of a packaging structure in accordance with one embodiment.

Referring to FIG. 1, the present embodiment discloses a novel, digital, and returnable packaging structure for photovoltaic modules. This packaging structure comprises a pallet 1. Positioned atop pallet 1 is a packaging box 2, designed for the support and accommodation of photovoltaic modules. In some configurations, several packaging boxes 2 may be stacked at equidistant intervals. The uppermost packaging box 2 is topped with a cover plate 3. Pallet 1, packaging box 2, and cover plate 3 are securely bound together externally with binding straps 4, ensuring a stable and combined connection that facilitates the secure packaging and transport of photovoltaic modules.

Figure 2:
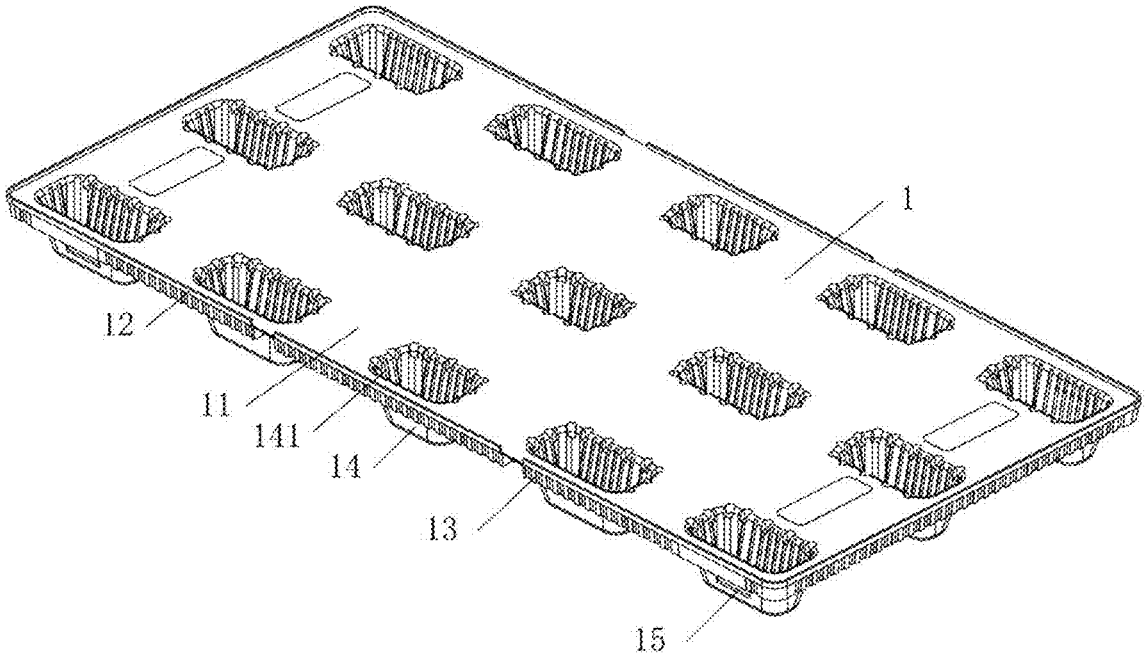
FIG. 2 is a schematic diagram of a pallet body of the packaging structure.
Figure 3:
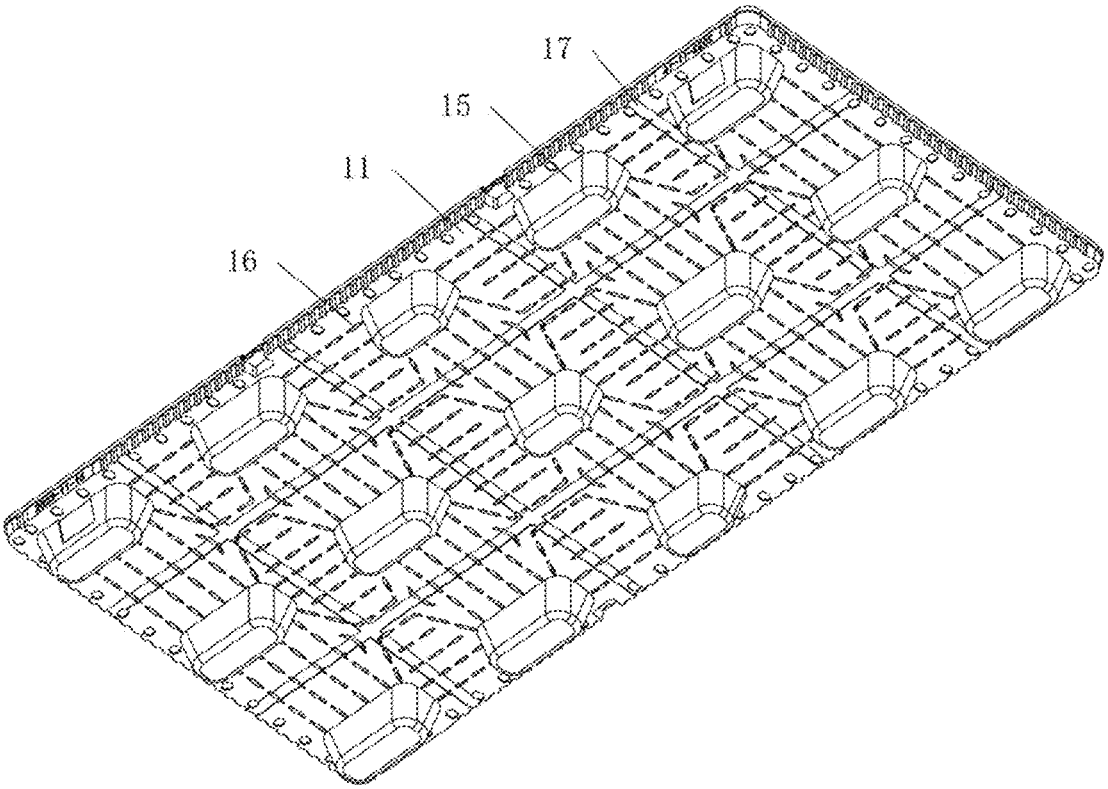
FIG. 3 is a bottom view of the pallet body.
Figure 4:
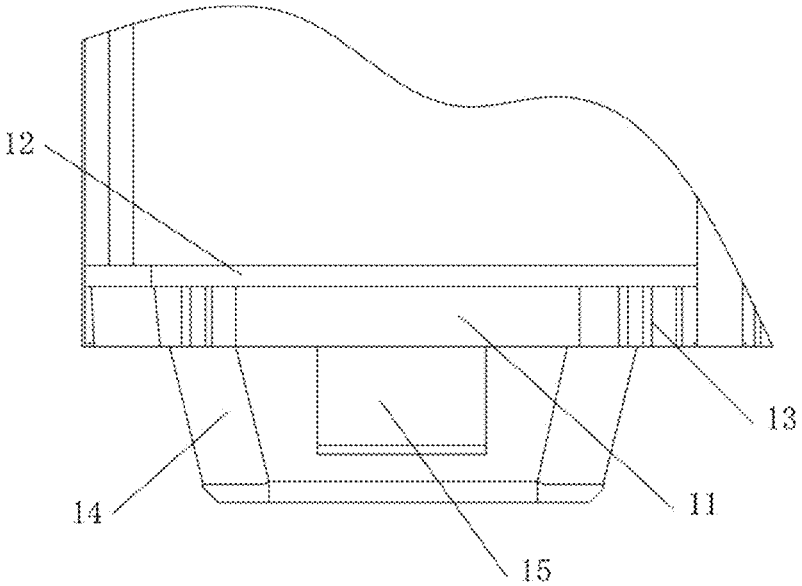
FIG. 4 is a front view detailing parts of the pallet body.

As illustrated in FIGS. 2, 3, and 4, pallet 1 of this embodiment comprises a pallet body 11 wholly manufactured from plastic material, possessing sides and opposed upper and lower ends. Affixed to the outer upper end of pallet body 11 are side strips 12 designed for precise and secure attachment, thus ensuring effective positional limitation. Pallet body 11 features side slots 13 to aid in the packaging structure. This design not only reduces the weight of pallet 1 but also maintains its overall structural integrity. Formed integrally with and extending downward from pallet body 11 are concavely shaped support legs 14, which are evenly spaced and arranged in about three rows. This configuration significantly enhances the load-bearing capacity of pallet body 11. On the outermost support legs 14 are label positions 15 intended for the placement and recognition of electronic labels. These electronic labels can be swiftly read by an external reader, thereby minimizing the potential for human error in identification. Either the upper or lower end of pallet body 11 features multiple equidistant, substantially circular grooves 16, designed for weight reduction. Additionally, pallet body 11 includes grid-patterned strap slots 17 at the lower end, providing enhanced stability for packaging.

Each of support legs 14 features equidistantly spaced reinforcement grooves 141 located in the upper interior, designed to reduce the weight of support legs 14 without sacrificing their structural integrity.

Justification Note: Reinforcement grooves 141, while primarily located in the upper interior as described, may extend along the length of support legs 14. This ensures further weight reduction and maintains structural integrity, aligning with the inventive concept disclosed in the Provisional Patent Application Ser. No. 63/624,937.

Side strips 12 are distributed at regular intervals along the upper end of pallet body 11. The arrangement of these strips, with spaces between adjacent ones, ensures efficient positional limitation and anti-slip properties. About five columns of support legs 14 are uniformly spaced within pallet body 11, with corresponding label positions 15 on the outermost support legs 14. These label positions 15 ensure the stable placement of electronic labels, thereby facilitating effective identification and reducing the likelihood of mix-ups. Electronic labels themselves are a combination of RFID, barcode, and QR code. Their information encoding structure comprises 16 characters: 2 for ownership code, 4 for product type code, 8 for sequence number, and 2 for year, enabling cyclical recognition and significantly improving the management of pallets.

Figure 5:
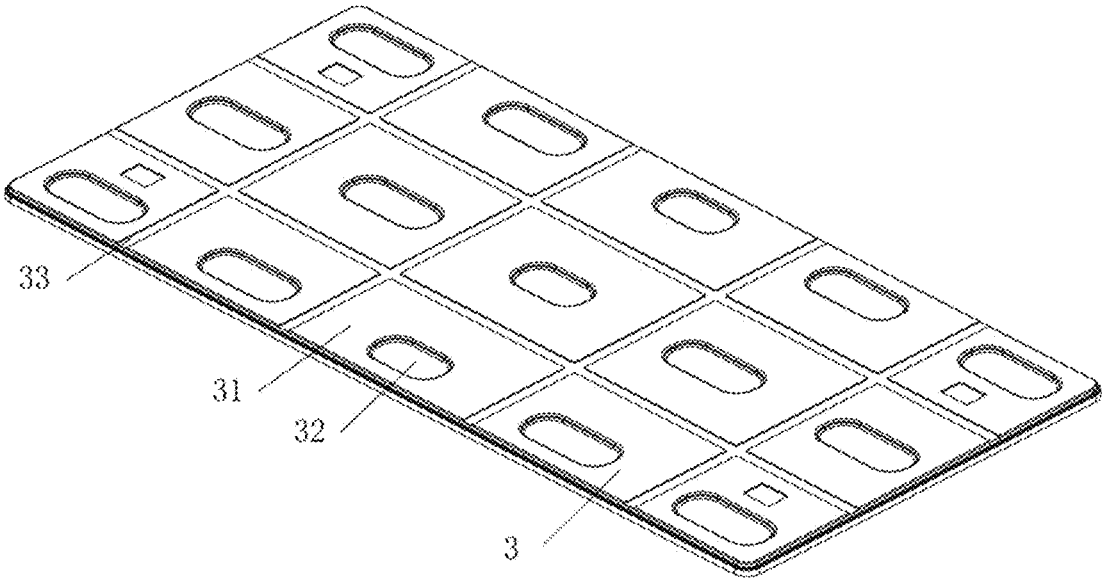
FIG. 5 is a three-dimensional view of a cover plate of the packaging structure.

Referring now to FIG. 5, within this embodiment, cover plate 3 includes a cover plate body 31, wholly manufactured from plastic material and featuring opposed upper and lower ends. Cover plate 3 is positioned atop packaging box 2, though multiple packaging boxes may also be used. This design aids in the packaging and transportation of photovoltaic modules. Internally, at the upper end of cover plate body 31, are placement slots 32 arranged in about three equidistant rows. The arrangement of placement slots 32 is symmetrically aligned with the positions of support legs 14 within pallet body 11, facilitating stable stacking and placement, which enhances the transport stability of photovoltaic modules. Additionally, cover plate body 31 is equipped with banding notches 33 designed for binding and positioning. Banding notches 33 located at the upper end of cover plate body 31 and strap slots 17 positioned at the lower end of pallet body 11 are designed to work in tandem. This arrangement allows binding straps 4 to securely fasten and bundle packaging box 2, ensuring a robust and stable packaging configuration.

Operation of the Preferred Embodiments

To initiate the use of this packaging structure, photovoltaic modules are first placed inside packaging box 2, thereby providing initial protection and containment. Alternatively, multiple packaging boxes may be used if necessary. Subsequently, packaging box 2 is placed atop pallet body 11. This arrangement ensures that pallet body 11 offers stable support to packaging box 2 or multiple layers of packaging boxes. Upon completion of this placement, cover plate 3 is positioned atop packaging box 2 or the uppermost packaging box. This placement of cover plate 3 facilitates an even distribution of pressure across packaging box 2 or the stacked packaging boxes, thereby enhancing the overall stability of the packaging structure.

The final stage involves securing the packaging structure with binding straps 4, which are wrapped around pallet 1, packaging box 2, and cover plate 3. Alternatively, if multiple packaging boxes are used, the binding straps will secure them as well. These straps interact with strap slots 17 located at the lower end of pallet body 11 and banding notches 33 at the upper end of cover plate body 31, providing a stable and secure bundling arrangement. This combination of pallet 1 and cover plate 3 forms a cohesive and robust packaging and transportation structure, ensuring the high stability and safety of the photovoltaic modules during transit.

Pallet body 11 is uniquely designed to cooperate with the equidistantly positioned side strips 12 and support legs 14, located on its outer upper end and interior respectively. This feature effectively restricts the movement of photovoltaic modules, thus preventing slippage and ensuring a stable and supportive environment, reducing the risk of deformation under stress.

For enhanced management and operational efficiency, label positions 15 are established on the exterior of the outermost support legs 14. These positions accommodate electronic labels, which are a composite of RFID, barcode, and QR code technologies. A reading device can be installed on forklifts for the convenient reading and recognition of these electronic labels, eliminating the need for manual visual inspection. This approach significantly streamlines the combined usage of pallet 1 and photovoltaic modules, avoiding confusion and ensuring consistency in the transportation of the packaged photovoltaic modules. This integration of digital technology enhances management efficiency and convenience.

Pallet body 11 is constructed entirely from a plastic material, conferring both high load-bearing capacity and longevity. This design allows for repeated transportation uses. Additionally, the incorporation of side slots 13 and substantially circular grooves 16 along the sides and at either the upper or lower end of pallet body 11 effectively reduces the overall weight of pallet 1. This design maintains the structural integrity and supports the strength of pallet 1, thus achieving a balance between economic efficiency and environmental sustainability.

Furthermore, cover plate body 31 is ingeniously designed to align with about three rows of placement slots 32 on its upper end. These placement slots 32 enable the stable support of an upper layer pallet 1. Support legs 14 inside the upper layer pallet body 11 are designed to fit snugly into placement slots 32 at the upper end of cover plate body 31, facilitating a precise and secure placement. This design ensures that cover plate body 31 provides robust support for pallet body 11 positioned above it, thereby maintaining the overall stability and security of the packaged photovoltaic modules during transportation.

Conclusion and Ramifications

Accordingly, the reader will see that a digitalizing and returnable packaging structure is suitable for a range of modular items, including photovoltaic modules. This packaging structure incorporates a pallet, specifically a pallet body, which is designed to work in conjunction with side strips and support legs, evenly distributed along its outer upper end and interior respectively. This design facilitates the precise positioning and stable support of photovoltaic modules during transportation. Additionally, the inclusion of side slots and substantially circular grooves contributes to reducing the weight of the pallet body, while ensuring the stability of its overall support strength, thus enabling efficient and stable transportation of photovoltaic modules.

Moreover, the packaging structure features a cover plate body that works in conjunction with the pallet body to create a highly stable packaging and transportation state. Banding notches at the upper end of the cover plate body and strap slots at the lower end of the pallet body are designed to interlock, allowing binding straps to securely fasten the packaged photovoltaic modules. Furthermore, the placement slots located at the upper end of the cover plate body are designed to align and interface with the upper layer pallet body, providing additional positional support and ensuring the stability of multiple stacked pallets.

Additionally, the implementation of electronic labels at the label positions located on the exterior of the support legs enhances digital tracking and management of both pallets and photovoltaic modules.

It is to be understood that the digitalizable and returnable packaging structure for various modular items, such as photovoltaic modules, is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A digitalizable and returnable packaging structure for various modular items, comprising:

a pallet with a pallet body having sides and an upper end and an opposed lower end;

a plurality of side strips affixed to an outer portion of the upper end of said pallet body;

a plurality of side slots on the sides of said pallet body;

a plurality of grooves arranged at either the upper end or the lower end of said pallet body;

a plurality of strap slots at the lower end of said pallet body;

a plurality of concavely shaped support legs integrally formed with and extending downwards from said pallet body;

a plurality of label positions on the exterior of said support legs; and a cover plate positioned on an upper end of a packaging box.

2. The packaging structure of claim 1, further comprising a plurality of binding straps for securing said pallet, packaging box, and cover plate.

3. The packaging structure of claim 1, wherein said side strips are arranged in multiple equidistant sections along the outer portion of the upper end of said pallet body, with gaps between adjacent said side strips.

4. The packaging structure of claim 1, wherein said grooves are equidistantly arranged.

5. The packaging structure of claim 4, wherein each of said grooves is substantially circular in shape.

6. The packaging structure of claim 1, wherein said support legs are equidistantly arranged and are organized into between four and six columns within said pallet body.

7. The packaging structure of claim 6, wherein each of said support legs further comprises internal reinforcement grooves.

8. The packaging structure of claim 1, wherein said label positions are correspondingly established on the outermost said support legs.

9. The packaging structure of claim 8, wherein said label positions contain electronic labels, configured in a tripartite format comprising RFID, barcode, and QR code components.

10. The packaging structure of claim 1, wherein said cover plate comprises:

a cover plate body having an upper end and an opposed lower end and adjoining the upper end of said packaging box, and placement slots and banding notches located at the upper end of said cover plate body.

11. A digitalizable and returnable packaging structure for various modular items, comprising:

a pallet with a pallet body having sides and an upper end and an opposed lower end;

a plurality of side strips affixed to an outer portion of the upper end of said pallet body, arranged in multiple equidistant sections along the outer portion of the upper end of said pallet body, with gaps between adjacent said side strips;

a plurality of side slots on the sides of said pallet body;

a plurality of grooves arranged at either the upper end or the lower end of said pallet body, equidistantly arranged, wherein each of said grooves is substantially circular in shape;

a plurality of strap slots at the lower end of said pallet body;

a plurality of concavely shaped support legs integrally formed with and extending downwards from said pallet body, equidistantly arranged and organized into between four and six columns within said pallet body, each of said support legs further comprising internal reinforcement grooves;

a plurality of label positions on the exterior of said support legs, correspondingly established on the outermost said support legs, containing electronic labels configured in a tripartite format comprising RFID, barcode, and QR code components; and a cover plate positioned on an upper end of a packaging box, said cover plate comprising a cover plate body having an upper end and an opposed lower end and adjoining the upper end of said packaging box, with placement slots and banding notches located at the upper end of said cover plate body.

12. The packaging structure of claim 11, further comprising a plurality of binding straps for securing said pallet, packaging box, and cover plate.

* * * * *